US005269383A

United States Patent [19]

Forrest

[11] Patent Number: 5,269,383

[45] Date of Patent: Dec. 14, 1993

[54] NAVIGABLE DOWNHOLE DRILLING SYSTEM

[75] Inventor: John Forrest, Houston, Tex.

[73] Assignee: Drilex Systems, Inc., Houston, Tex.

[21] Appl. No.: 822,359

[22] Filed: Jan. 15, 1992

[51] Int. Cl.[5] ..... E21B 4/02; E21B 7/04

[52] U.S. Cl. ..... 175/26; 175/40; 175/45; 175/106; 175/107

[58] Field of Search ..... 175/107, 104, 106, 101, 175/92, 95, 45, 40, 26; 415/122.1; 418/48

[56] References Cited

U.S. PATENT DOCUMENTS

| | | | |
|---|---|---|---|
| Re. 30,246 | 4/1980 | Richter, Jr. et al. | 175/107 X |
| 3,807,512 | 4/1974 | Pogonowski et al. | 175/107 X |
| 4,047,581 | 9/1977 | Erickson | 175/107 X |
| 4,260,032 | 4/1981 | Fox | 175/107 |

*Primary Examiner*—Stephen J. Novosad

*Attorney, Agent, or Firm*—Edgar A. Zarins; Malcolm L. Sutherland

[57] ABSTRACT

A navigable downhole drilling system incorporating a drilling motor having a system of sensors and information processors for determining the depth, inclination, direction and thrust of the drilling motor. Accordingly, the drilling operation can be continuously monitored and adjusted to ensure desired directional drilling. A programmed processor may be incorporated into the drilling system to guide the drilling motor along a predetermined course. A generator assembly provides power to the processors and sensors as a result of the precessional rotation of the rotor within the stator of the drilling motor. The overall length of the drilling system is minimized by piggybacking the thrust bearings with the power generation unit and siamesing the transmission assembly for the drilling motor with the power section of the motor. As a result, a downhole drilling system of navigable length is created which can be readily directed along the desired course.

22 Claims, 6 Drawing Sheets

NAVIGABLE DOWNHOLE DRILLING SYSTEM

BACKGROUND OF THE INVENTION

I. Field of the Invention

The present invention is directed to a navigable downhole drilling system for directional drilling and, in particular, to a "smart" driller which continuously monitors and corrects the path of the directional drilling for optimum positioning of the borehole.

II. Description of the Prior Art

Directional drilling has become increasingly important in the exploration for fossil fuels as well as the extraction of environmentally hazardous materials from the earth. Directional drilling facilitates penetration scattered fuel deposits from a single surface well or horizontal penetration to improve extraction. However, as the depth increases and precision of directional drilling becomes increasingly important, an accurate determination of the positioning of the drill bit or the downhole drilling system is necessary. Early downhole drilling systems relied upon calculations as to position based upon the total length of drilling string and the kick-off or build rate of the drilling system. However, such directional drilling can be affected by unknown factors such as the formations through which the drilling system must pass. Although a reasonable determination of position could be calculated, precise positioning was unknown.

Measurement-While-Drilling or MWD's have become widely accepted as a means of monitoring the direction and position of the drilling system. MWD's transmit a signal pulse to the surface which provides information relating to total depth and inclination. However, it can take several seconds for the information to reach the surface and several additional seconds before a course correction can be instituted at which time the information may no longer be accurate. In addition, transmission of the data is subject to several types of interference. MWD's typically utilize strain gauges to determine bending of the external casing which may be a result of the proper build rate or an encounter with an unanticipated formation. Finally, MWD's are added to the drilling system increasing the overall length of the drilling system. As length of the drilling system is increased potential build rate is sacrificed.

The prior known drilling systems do not incorporate means for monitoring and adjusting the direction of drilling. Although the direction of drilling can be controlled from the surface by varying thrust drill pipe orientation, and drilling fluid, an optimum system would carry out course corrections as new formations are encountered, etc. Such a downhole system would eliminate the delay associated with the transmission of information to the surface and subsequent correction. Consequently, only intermittent transmission of data would be necessary to keep the surface rig informed of drilling progress. Alternatively, a signal could be transmitted only when it becomes necessary to vary parameters controlled at the surface. The prior art systems are not capable of such sophisticated directional drilling.

SUMMARY OF THE PRESENT INVENTION

The present invention overcomes the disadvantages of the prior known directional drilling systems by providing a fully navigable, self-contained directional drilling system capable of precise monitoring and course correction.

The navigable downhole drilling system of the present invention generally includes a positive displacement drilling motor driven by pumping drilling fluids therethrough, a power generator and/or additional battery back-up source which translates the precessional rotation of the rotor of the drilling motor into electrical power, a thrust bearing assembly above the drilling motor in conjunction with the generator to reduce the overall length of the system, and series of sensors for monitoring direction, inclination, depth and thrust on the shaft associated with the drill bit. The system may also include a data processor closely associated with and powered by the generator which processes the signals from the sensors and transmits appropriate data to the surface while correcting and determining direction of the drilling. The processor may be pre-programmed to guide the drilling system along a desired path. The power generated downhole can be utilized to operate the sensors and any other instruments associated with the drilling system. A battery back-up associated with the electrical power system can be used to sustain the processors during the time fluid is not circulating through the motor or when circulation is below the electrical power generation threshold.

The sensors incorporated to monitor operation of the drilling system may include sensors built into the radial bearings supporting the output shaft of the motor to determine the position of the shaft relative to the radial bearings. As a result, strain and bend of the shaft can be monitored providing an indication of the force applied between the bit and formation and direction of travel. Inclination sensors associated with the drilling motor transmit information regarding the angle of the drilling system. Controlled parameters such as the flow of drilling fluid which is directly related to the power output of the drilling motor, the angle of any bent housing incorporated into the system, thrust generated at the surface, and rotation of the drill string all form part of the equation to determine well trajectory. Thus, the drilling motor acts as a mechanical sensor, the power section monitoring torque, speed and pressure drop and the output section monitoring inclination, tool face, direction, thrust and lateral force applied between the bit and the formation.

Thus, the directional drilling system is shortened in effective length by piggybacking components and reducing the length of the power section by changing the helical configuration of the rotor/stator while power output, including torque and speed, is maintained at optimum levels to drive the drill bit. A composite stator construction enables maintenance of power output since the primary helical configuration is derived from formed metal components with one of the mating surfaces of either the rotor or stator soft-coated with an elastomer. The reduction in mass made possible by the tubular design of the rotor/stator radically reduces vibration levels from the power section. In turn, the hollow nature of the composite stator enables hard wiring to be passed between the stator former and the outer motor casing. These wires are used to transmit signals from the sensors.

The power crank assembly connected to the thrust bearing rotates at the precessional speed of the rotor which corresponds to the number of helical lobes on the rotor. This power crank is coupled to an electrical generator to provide power for the sensor in the motor and also to power an electric or electro-hydraulic servo system which will apply lateral forces to the drilling assembly downhole to enable the drill bit to change direction.

The drilling system can also be linked to a thruster assembly which can automatically supply weight to the bit where there is force de-coupling similar to that which occurs in deep drilling, horizontal drilling or in drilling with coiled tubing.

Finally, the entire systems may be constructed in a modular form to provide maximum flexibility in assembly in a directional drilling system in accordance with geological formations and applications.

Other objects, features and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views and in which.

DETAILED DESCRIPTION OF A PREFERRED EMBODIMENT OF THE PRESENT INVENTION

Figure 1A:
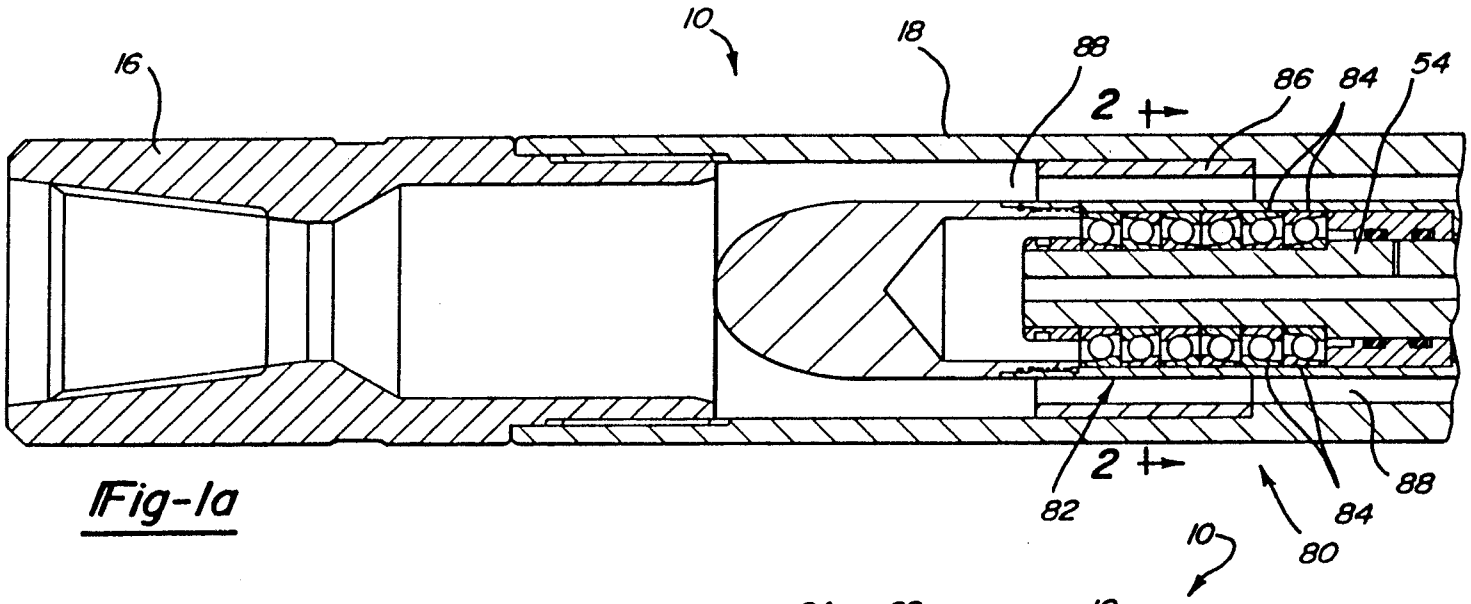
FIGS. 1*a*–1*d* show a cross-sectional perspective of a navigable downhole directional drilling system embodying the present invention.
Figure 1B:
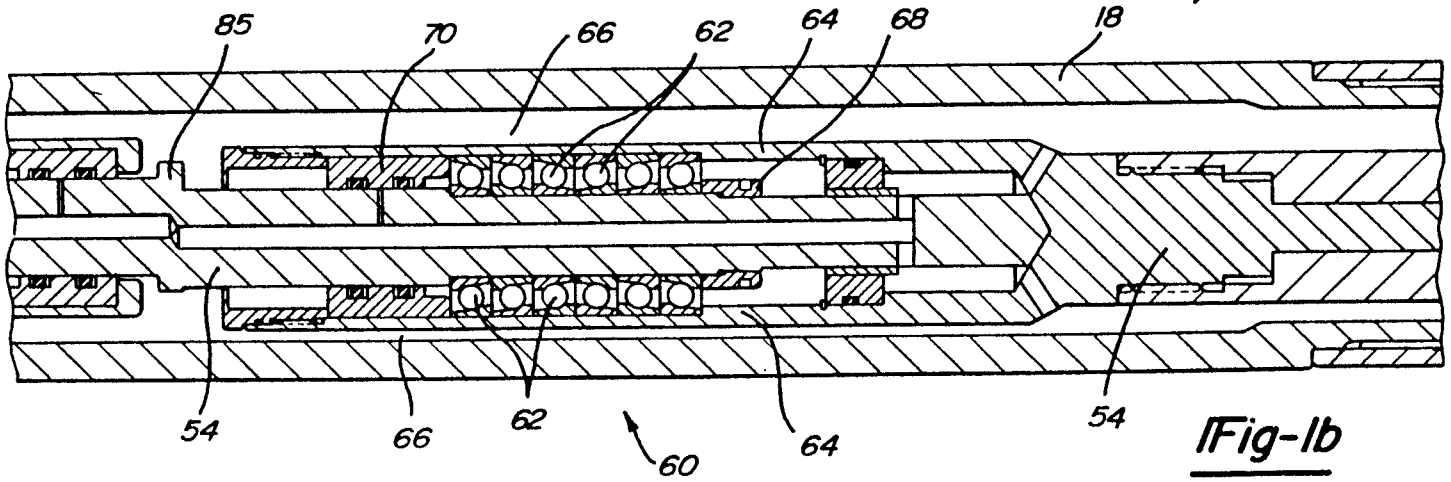
Figure 1C:
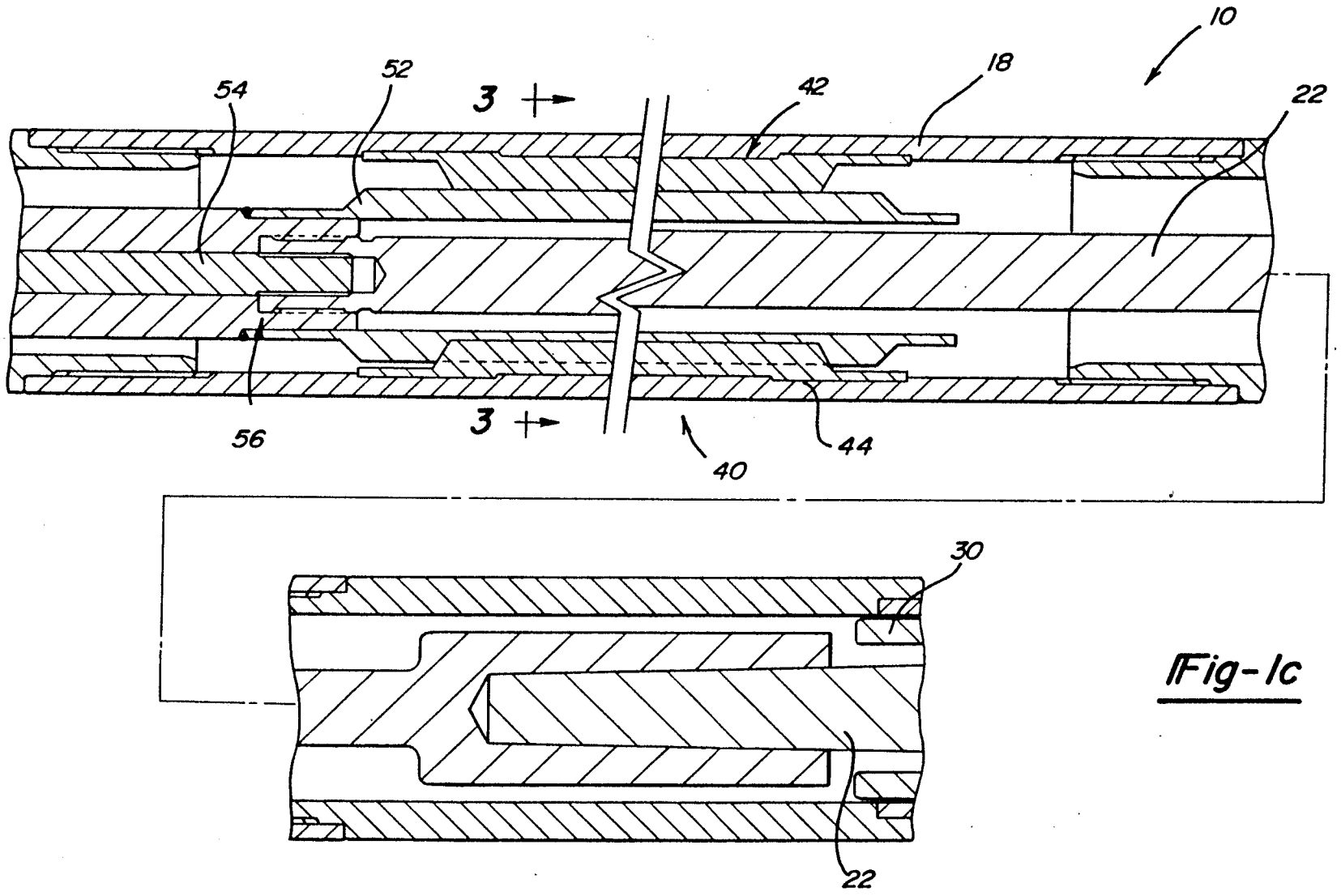
Figure 1D:
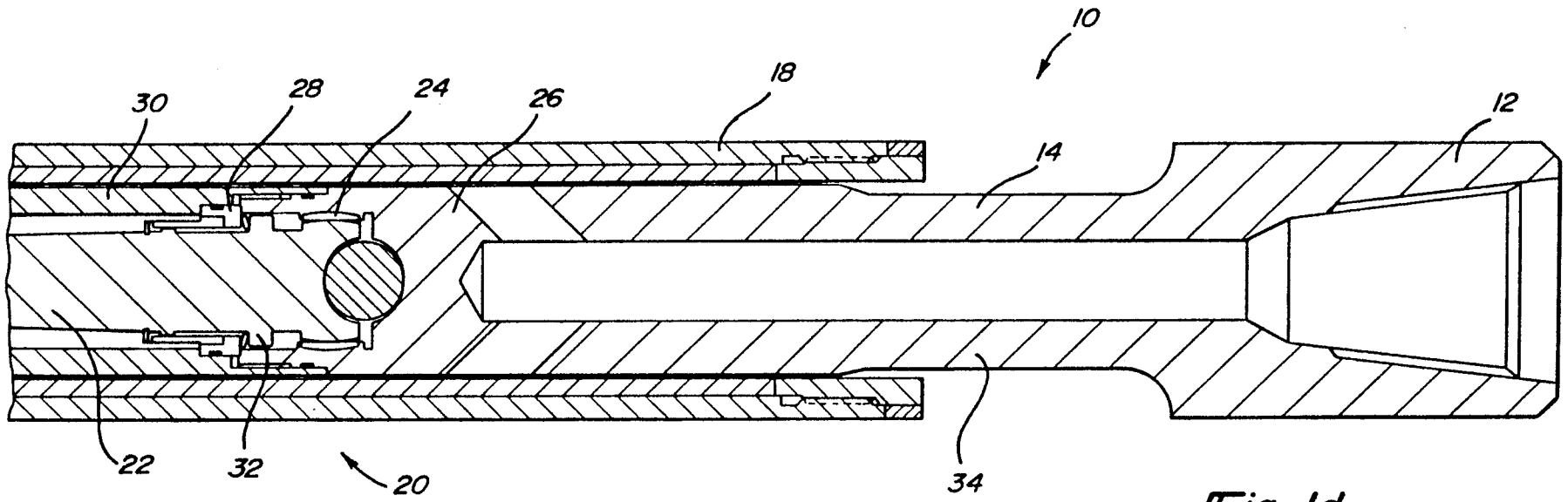
Figure 2:
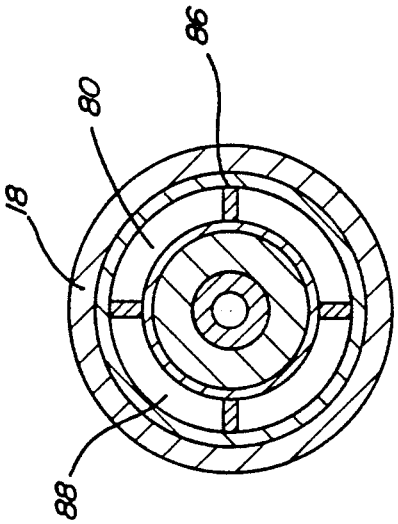
FIG. 2 is a lateral cross-sectional view taken along lines 2—2 of FIG. 1*a;*
Figure 3:
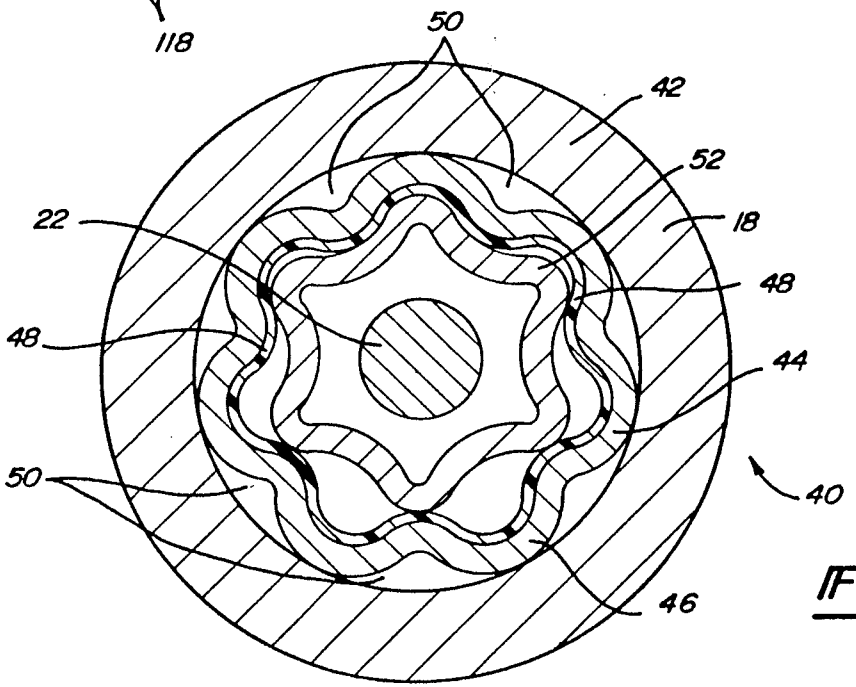
FIG. 3 is a lateral cross-sectional view taken along lines 3—3 of FIG. 1*c.

Referring first to FIGS. 1*a*–1*d* through 3, there is shown a navigable downhole drilling system 10 for the controlled drilling of a well bore in predetermined direction. The drilling system 10 is adapted to drill a wellbore along a desired path while monitoring the progress and position of such directional drilling. The drilling system 10 carries out the directional drilling without greatly increasing the overall length of the tool which can inhibit the build rate of an offset wellbore. The effective length of the drilling system 10 is reduced by piggybacking certain components reducing their combined lengths while incorporating measurements of the well trajectory and drilling mechanics within the drilling motor. Nevertheless, power output equivalent to existing drilling motors is maintained thereby maintaining the torque and speed at near optimum levels to drive the drill bit (not shown).

The drilling system 10 of FIGS. 1*a*–1*d* through 3 generally comprises four sections. A bit box 12 to which a drill bit (not shown) is mounted and drivably connected to a transmission assembly 20 through a shaft 14. The transmission assembly 20 in turn is operatively connected to a power section 40 incorporating a positive displacement, multi-lobed helical drill motor 42 which is operated by pumping drilling fluid through the power section 40. Positioned above the power section 40 and drivably connected thereto is a thrust bearing assembly 60 and power generator assembly 80 which translates the precessional motion from the drill motor 42 into electrical power to operate sensors and information processors associated with the drilling system 10. The thrust bearing assembly 60 absorbs the thrust loads associated with directional drilling. The drilling system 10 is adapted to be connected to a drill string or other downhole equipment through the top sub 16. The drilling system 10 includes an outer housing 18 which encloses the components and facilitates pumping of drilling fluid through the tool.

The transmission assembly 20 transmits the rotational drive from the output shaft 22 of the drill motor 42 to the shaft 14 of the bit box 12 to drive the drill bit independently of and rotation of the drill string. The transmission assembly 20 includes a socket joint 24 to transmit the non-axial rotation of the output shaft 22 to the bit shaft 14. The joint 24 includes a ball bearing 26, locking ring 28 and locking sleeve 30. The locking sleeve 30 is threadably connected to the shaft 14 and engages the locking ring 28. A radial flange 32 on the output shaft 22 engages the locking ring 28 to prevent withdrawal of the output shaft 22 from the joint 24. The output shaft 22 of the motor 42 is allowed to pivot about the bearing 26 to remove the eccentric motion of the drill motor 42 yet rotation of the output shaft 22 is transmitted to the shaft 14 of the bit box. Drilling fluid is permitted to circumvent the transmission assembly 20 to enter the fluid passageway 34 to the drill bit. Sensors for determining the position of the drilling system 10 and formations encountered can be installed proximate the transmission assembly 20 as will be subsequently described. Thus, the transmission section 20 delivers the power section 40 torque while removing the eccentric motion of the rotor relative to the housing 18 center line.

The power section 40 is the heart of the drilling system 10 and facilitates the directional drilling. In the typical directional drilling operation, during linear drilling both the entire drill string and the drilling motor 42 are operated. During offset or directional drilling only the drilling motor 42 is operated to create the arcuate borehole. The drill motor 42 of the power section 40 preferably includes a composite stator 44 having a helical stator former 46 to which is applied an elastomer lining 48. The stator former 46 has a uniform wall thickness and provides the necessary stiffness to accommodate the torques applied to the drilling motor 42 while the elastomer lining 48 provides the necessary sealing properties for operation of the positive displacement motor 42. The stator former 46 is mounted to the housing wall 18 thereby forming a plurality of helical spaces 50 through which hard wiring can be passed from the transmission of power and signals to and from sensors downhole of the drilling motor 42. The reduction of mass made possible by the thin-walled tubular stator 44 radically reduces vibration levels from the power section 40.

A helical rotor 52 is rotatively positioned with the stator 44 for displacement as drilling fluid is pumped through the drilling motor 42. The upper end of the rotor 52 is coupled to the upper end of the output shaft 22 to transmit the motion of the rotor 52 within the stator 44 to the output shaft 22. Also coupled to the upper end of the rotor 52 is a crank shaft 54. The three-way coupling 56 facilitates transmission of the rotor motion while containing a majority of the transmission within the rotor 52.

In contrast to typical drilling motors, the thrust bearings 60 of the present invention is removed from the output shaft 22 of the motor 42 and placed above the power section 40. The thrust bearing load, which is the vector sum of the weight applied to the drill bit and the rotor thrust, is transmitted through the crank shaft 54 driven by the upper coupling 56 to the rotor 52. A first end of the crankshaft 54 rotates with the rotor 52 while the other end of the crankshaft 54 will be concentric with the outer housing 18 thereby translating the precessional motion of the rotor 5 and the lower end of the crankshaft 54 to a rotational motion in the upper end of the crankshaft. This arrangement enables the thrust bearings 62 to be sealed in an extremely rigid housing 64. Drilling fluid flowing to the power section 40 passes through the annular spaces 66 between the outer housing 18 and the bearing containment enclosure 64 to continuously cool the bearings 62. The thrust bearings 62 are positionally captured between a lower capture ring 68 and an upper seal ring 70. Positioning of the thrust bearing assembly 60 above the drilling motor 42 reduces the effective length of the downhole drilling system 10. Whereas in the typical drilling motor accommodation of the thrust bearings required extension of the output shaft below the drilling motor, the thrust bearing assembly 60 of the present invention is essentially piggybacked with the generator assembly 80 in a section of the system 10 which essentially forms a part of the drill string carrying the drilling motor 42.

The generator section 80 translates the rotation of the crankshaft 54 into electrical power for sensors and instruments associated with the drilling system 10. The simple rotation of the rotor 52 within the drilling motor 42 is not sufficient to create the required electrical power. However, the crankshaft 54 transmits the precessional motion of the rotor 52 to the generator section 80. The crank 54 rotates at the precession speed of the rotor 52 which is a multiple of the number of helical lobes or teeth on the rotor and the output shaft speed from the transmission. Coupled to an electrical generator 82, sufficient electrical power may be generated for the sensors and also to power an electric or electrohydraulic servo system which will apply lateral forces to the drilling assembly to enable the drill bit to change its direction. The upper end of the crankshaft 54 rotates within the generator 82 in axial alignment with the center of the housing 18. An offset 84 in the crank 54 translates the precessional motion of the rotor output to the rotation within the generator 82. The generator 82 includes a plurality of coils 84 through which the power is generated. The generator 82 is supported by sleeve 86 which allows the flow of drilling fluid through annular space 88 to the remainder of the drilling system 10. A rechargeable battery system may be incorporated into the drilling system 10. The battery system would be recharged by the generator 82 thus sustaining electrical operating life while meeting high electrical wattage demands common to electrical servos. The battery system can sustain the processors when the drilling motor 42 is not in operation.

Figure 4A:
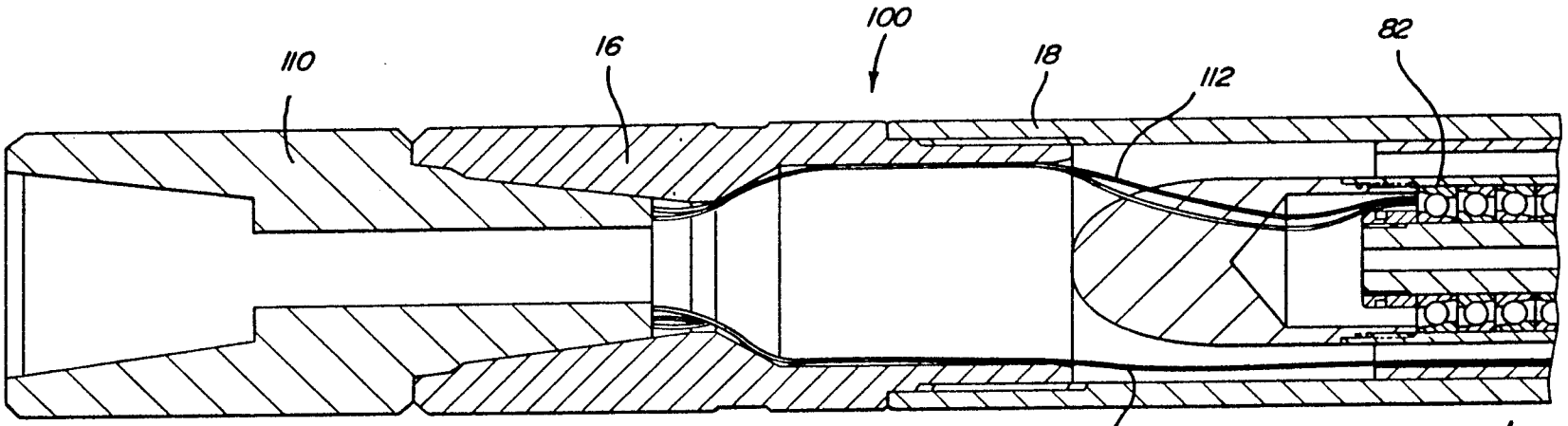
* and FIGS. 4*a*–4*d* show a cross-sectional perspective of a modified embodiment of the present invention.
Figure 4B:
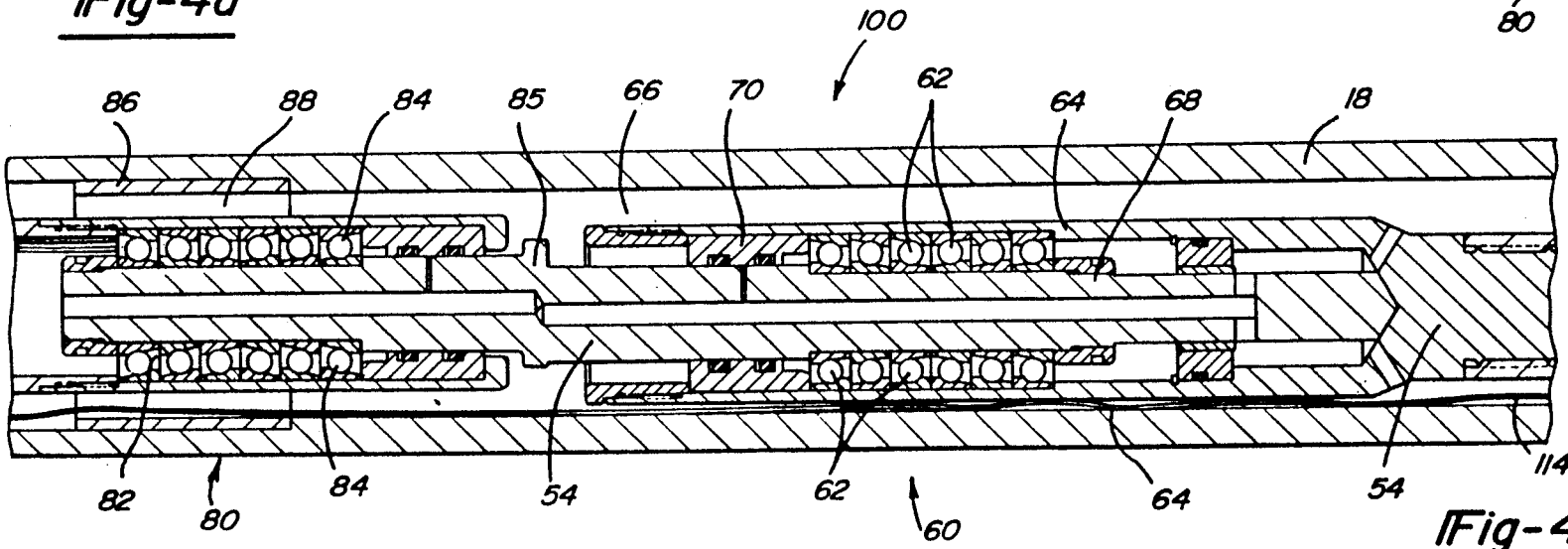
Figure 4C:
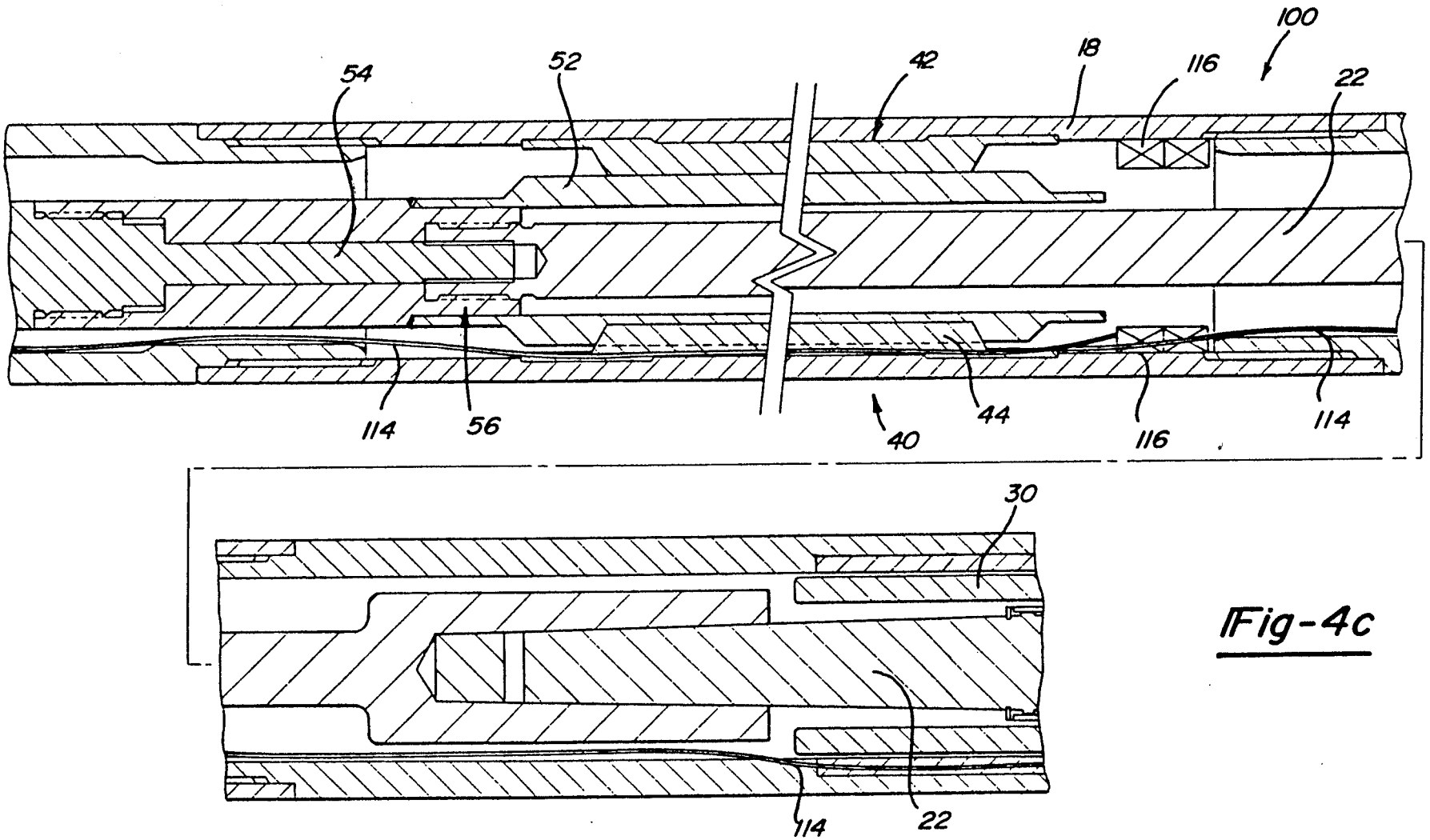
Figure 4D:
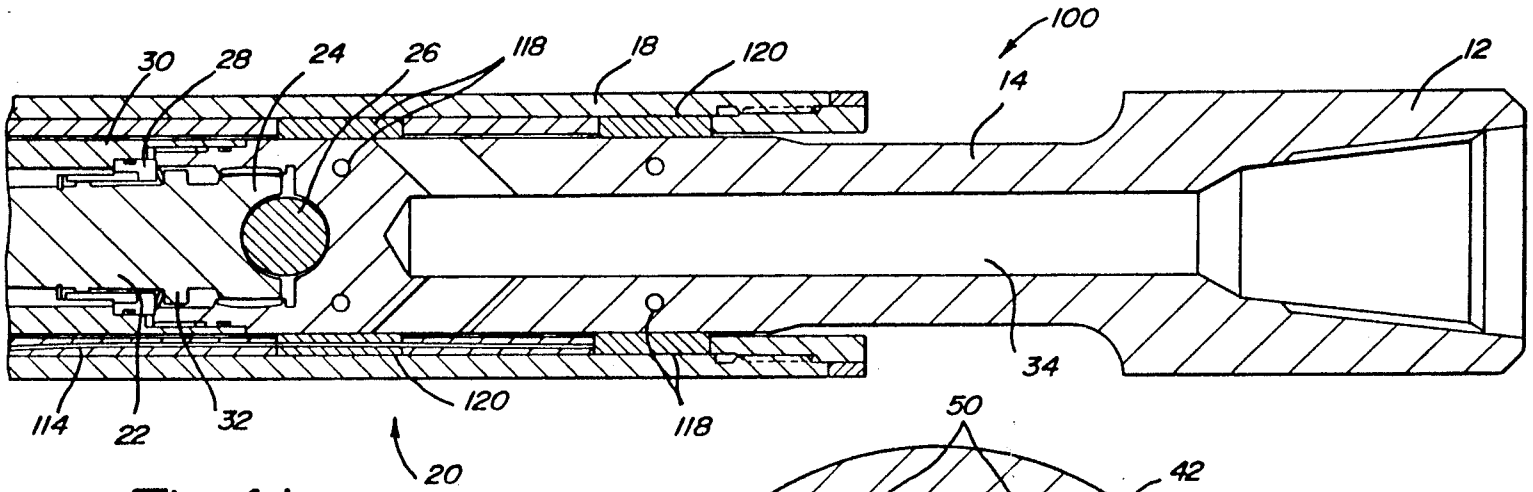

Referring now to FIGS. 4*a*–4*d*, the navigable drilling system of the present invention may be modified into a completely independent or "smart" drilling system 100 which can monitor and adjust the drilling course. The generator 80 creates the power to run the sensors and information processors making the system 100 independent of surface input. Preferably, an intermittent signal will be transmitted to the surface so that drilling progress can be monitored.

Attached to the upper end of the drilling system 100 is a microprocessor sub 110 used to process the signals from the motor sensors and conduct a comparison between the actual well bore trajectory and a predetermined stored trajectory loaded into memory at the surface. Such downhole signal processing, comparison and adjustment of lateral forces minimizes the need to transmit data to the surface. The signal transmission path to the surface can be used for other data such as geological information collected by other sensors. The only data transmitted to the surface will be a positional update at drilling intervals of several feet. In addition the signal processing unit 110 can be fitted either with its own signal transmission system or linked to other measurement-while-drilling devices in the drilling assembly.

The processor 110 is linked to the generator 80 by power wires 112 to deliver operating power and to various sensors by signal wires 114. Examples of sensors which may be incorporated into the drilling system 100 include inclinometers 116 proximate the drilling motor 42 and position monitoring sensors 118 in the transmission assembly 20. In a preferred embodiment, the output shaft 14 is radially located within the housing 18 by elastomer lined joinal bearings 120 in which proximity sensor 118 are located to determine the relative location between the shaft 14 and the motor housing 18. These bearings 120 permit some radial and longitudinal displacement of the shaft 14 relative to the housing 18. As a result, the processor 110 can determine such information as direction of travel, geological formations encountered by the bit face, thrust and lateral force applied between the bit and the formation.

Still further modifications may include connecting the drilling system to a thruster assembly which can automatically supply weight to the bit where there is force decoupling. It is contemplated that the entire drilling system will be configured in a modular form to give maximum flexibility in assembling a drilling system for specific tasks and geological formations.

The foregoing detailed description has been given for clearness of understanding only and no unnecessary limitations should be understood therefrom as some modifications will be obvious to those skilled in the art without departing from the scope and spirit of the appended claims.

What is claimed is:

1. A downhole drilling system for drilling a borehole along a predetermined trajectory, said drilling system connected to a drill string, said drilling system comprising:

a drilling motor for operating a drill bit independent of the drill string, said drilling motor including a stator and a rotor operatively displaceable within said stator, said drill bit drivably connected to said rotor;

means for measuring the operating parameters of said drilling system to ensure drilling along the predetermined trajectory; and power generation means drivably connected to said rotor of said drilling motor for supplying power to said measuring means of said drilling system.

2. The drilling system as defined in claim 1 and further comprising an information processing unit mounted within said drilling system in electrical communication with said measuring means and said power generation means, said generation means supplying power to operate said processing unit and said unit processing information communicated by said measuring means.

3. The drilling system as defined in claim 2 wherein said processing unit alters the trajectory of said drilling system in accordance with information communicated by said measuring means.

4. The drilling system as defined in claim 2 wherein said processing unit intermittently communicates a signal to the surface in accordance with information communicated by said measuring means.

5. The drilling system as defined in claim 1 wherein said power generation means is drivably connected to said rotor by a crankshaft which translates the precessional motion of said rotor to said power generation means, said crankshaft being connected to an upper end of said rotor.

6. The drilling assembly as defined in claim 5 and further comprising a transmission assembly axially below said drilling motor for transmitting the displacement motion of said rotor within said stator to said drill bit, said transmission assembly operatively connected to said upper end of said rotor by an output shaft and including a transmission shaft connected to said drill bit.

7. The drilling system as defined in claim 6 and further comprising a thrust bearing assembly contained within a sealed housing axially above said drilling motor, said thrust bearing assembly mounted to said crankshaft extending from said drilling motor.

8. The drilling assembly as defined in claim 7 wherein said upper end of said rotor, said crankshaft and said output shaft are connected by a single coupling such that thrust loads transmitted through said drill bit and output shaft are absorbed by said thrust bearing assembly.

9. The drilling assembly as defined in claim 6 wherein said measuring means includes first sensors proximate said transmission shaft for measuring forces acting upon said drill bit and second sensors proximate said drilling motor for measuring inclination of said drilling system along the trajectory.

10. The drilling assembly as defined in claim 9 wherein said transmission shaft is radially supported by joinal bearings, said first sensors mounted within said bearings to determine the location of said transmission shaft relative to said joinal bearings, said first sensors determining the radial and longitudinal displacement of said transmission shaft relative to said joinal bearings.

11. The drilling assembly as defined in claim 6 wherein said transmission assembly includes a transmission joint translating the eccentric motion of said output shaft to a rotary motion in said transmission shaft.

12. A downhole drilling system for drilling a borehole along a predetermined trajectory, said drilling system connected to a drill string, said drilling system comprising:

a positive displacement drilling motor for operating a drill bit independent of the drill string, said drilling motor including a stator, said drill bit drivably connected to said rotor by an output shaft;

means for measuring the operating parameters of said drilling system to ensure drilling along the predetermined trajectory;

power generation means drivably connected to said rotor of said drilling motor by a crankshaft whereby operation of said drilling motor drives said generation means, said generation means supplying power to said measuring means of said drilling system; and a thrust bearing assembly contained within a sealed-housing axially above said drilling motor, said thrust bearing assembly mounted to said crankshaft to absorb thrust loads associated with drilling.

13. The drilling system as defined in claim 12 and further comprising an information processing unit mounted within said drilling system in electrical communication with said measuring means and said power generation means, said generation means supplying power to operate said processing unit and said unit processing information communicated by said measuring means.

14. The drilling system as defined in claim 12 and further comprising a transmission assembly axially below said drilling motor for transmitting the displacement motion of said rotor to said drill bit, said transmission assembly including a transmission joint operatively connected to an upper end of said rotor by an output shaft of said drilling motor and to a transmission shaft connected to said drill bit.

15. The drilling system as defined in claim 14 wherein said measuring means includes first sensors proximate said transmission shaft for measuring forces acting upon said drill bit and second sensors proximate said drilling motor for measuring inclination of said drilling system along the predetermined trajectory.

16. The drilling system as defined in claim 15 wherein said first sensors include proximity sensors disposed within joinal bearings radially supporting said transmission shaft, said proximity sensors measuring radial and longitudinal displacement of said transmission shaft thereby determining forces acting on said drill bit.

17. The drilling system as defined in claim 14 wherein said upper end of said rotor, said output shaft of said drilling motor and said crankshaft are interconnected by a coupling.

18. A downhole drilling system for drilling a borehole along a predetermined trajectory, said drilling system connected to a drill string, said drilling system comprising:

a positive displacement drilling motor for operating a drill bit independent of the drill string, said drilling motor including a stator and a rotor operatively displaceable within said stator;

a transmission assembly axially below said drilling motor for transmitting the displacement motion of said rotor within said stator to said drill bit, said transmission assembly operatively connected to said drilling motor by an output shaft;

sensor means disposed within said drilling system for measuring the operating parameters of said drilling system to ensure drilling along the predetermined trajectory;

power generation means drivably connected to said rotor of said drilling motor by a crankshaft, whereby said drilling motor drives said generation means, said generation means supplying power to operate said sensor means of said drilling system; and a thrust bearing assembly contained within a sealed housing axially above said drilling motor, said sealed thrust bearing assembly mounted to said crankshaft to absorb the thrust loads associated with drilling.

19. The drilling system as defined in claim 18 and further comprising an information processing unit mounted within said drilling system, said generation means supplying power to operate said processing unit and said unit processing information communicated by said sensor means to ensure drilling along the predetermined trajectory.

20. The drilling system as defined in claim 18 wherein said output shaft of said drilling motor and said crankshaft are drivably connected to an upper end of said rotor by a coupling.

21. A downhole drilling system for drilling a borehole along a predetermined trajectory, said drilling system connected to a drill string, said drilling system comprising:

a positive displacement drilling motor for operating a drill bit independent of the drill string, said drilling motor including a stator and a rotor operatively displaceable with said stator, said rotor having a first shaft extending upwardly therefrom above said drilling motor;

a transmission assembly axially below said drilling motor for transmitting the displacement motion of said rotor within said stator to said drill bit, said transmission assembly operatively connected to said rotor of said drilling motor by an output shaft; and a thrust bearing assembly contained within a sealed housing axially above said drilling motor, said thrust bearing assembly connected to said first shaft extending upwardly from said rotor of said drilling motor such that said thrust bearing assembly and said first shaft are connected to an upper end of said rotor whereby thrust loads associated with drilling are absorbed by said thrust bearing assembly.

22. A downhole drilling system for drilling a borehole along a predetermined trajectory, said drilling system connected to a drill string, said drilling system comprising:

a positive displacement drilling motor for operating a drill bit independent of the drill string, said drilling motor including a stator and a rotor operatively displaceable within said stator;

a transmission assembly axially below said drilling motor for transmitting the displacement motion of said rotor within said stator to said drill bit, said transmission assembly operatively connected to said drilling motor by an output shaft and including a transmission shaft connected to said drill bit;

first sensors proximate said transmission shaft for measuring and communicating forces acting upon said drill bit;

second sensors mounted within said drilling system for measuring and communicating inclination of said drilling system along the trajectory;

third sensors proximate said drilling motor for measuring and communicating operating parameters of said drilling motor;

power generation means drivably connected to said rotor of said drilling motor by a crankshaft whereby precession motion of said rotor within said drilling motor is transmitted through said crankshaft to drive said generation means said generation means supplying power to operate said sensors.

* * * * *